US008459952B2

(12) United States Patent
Behnke et al.

(10) Patent No.: US 8,459,952 B2
(45) Date of Patent: Jun. 11, 2013

(54) DEVICE AND METHOD FOR CONNECTING A BLADE TO A ROTOR SHAFT OF A CONTINUOUS FLOW MACHINE

(75) Inventors: Klaus Behnke, Schriesheim (DE); Uwe Quitmann, Willich (DE)

(73) Assignee: MAN Turbo AG, Oberhausen (DE)

( * ) Notice: Subject to any disclaimer, the term of this patent is extended or adjusted under 35 U.S.C. 154(b) by 590 days.

(21) Appl. No.: 12/720,796

(22) Filed: Mar. 10, 2010

(65) Prior Publication Data

US 2010/0232969 A1 Sep. 16, 2010

(30) Foreign Application Priority Data

Mar. 16, 2009 (DE) ..... 10 2009 013 348

(51) Int. Cl.
*F01D 5/30* (2006.01)

(52) U.S. Cl.
USPC ..... 416/217; 416/204 A; 416/222

(58) Field of Classification Search
USPC ..... 416/204 A, 204 R, 210 A, 210 R, 416/217, 222, 220 R
See application file for complete search history.

(56) References Cited

U.S. PATENT DOCUMENTS 2,944,787 A * 7/1960 Gingras ..... 416/140
2,980,395 A * 4/1961 Rubbra et al. ..... 416/131
3,400,912 A * 9/1968 Carta et al. ..... 416/220 R
5,405,245 A * 4/1995 Cornelius ..... 416/215
5,580,219 A * 12/1996 Frey et al. ..... 416/217
6,213,719 B1 * 4/2001 Violette et al. ..... 416/205
7,104,758 B2 * 9/2006 Brock et al. ..... 416/190

FOREIGN PATENT DOCUMENTS

DE 2952023 A1 12/1989
DE 3917034 A1 6/1998
JP 54-130711 * 10/1979

OTHER PUBLICATIONS

Kimura, Turbine Moving Blade, Oct. 11, 1979, Abstract of JP 54-130711.*

* cited by examiner

*Primary Examiner* — Edward Look
*Assistant Examiner* — Liam McDowell
(74) *Attorney, Agent, or Firm* — Cozen O'Connor

(57) ABSTRACT

A device for connecting a blade to a rotor shaft of a continuous flow machine, includes a first fork foot which has a quantity of first foot lugs with first bore holes, a second fork foot which has a quantity of second foot lugs with second bore holes, and at least one connection bolt which passes through first and second bore holes to connect the first fork foot to the second fork foot. The device has a first area with a predetermined first diameter difference between a first inner diameter of one of the bore holes and a first outer diameter of the connection bolt, and a second area with a predetermined second diameter difference between a second inner diameter of one of the bore holes and a second outer diameter of the connection bolt, wherein the first diameter difference and the second diameter difference differ from one another.

20 Claims, 8 Drawing Sheets

DEVICE AND METHOD FOR CONNECTING A BLADE TO A ROTOR SHAFT OF A CONTINUOUS FLOW MACHINE

BACKGROUND OF THE INVENTION

1. Field of the Invention

The present invention is directed to a device for connecting a blade to a rotor shaft of a continuous flow device, in particular of a steam turbine or gas turbine or compressor, and to a method for the production thereof.

2. Description of the Related Art

Devices of the type mentioned above generally comprise a first fork foot which is fixedly connected to the blade and which has a quantity of first foot lugs with first bore holes, a second fork foot which is fixedly connected to the rotor shaft and which has a quantity of second foot lugs with second bore holes, and at least one connection bolt which passes through first and second bore holes of the interengaging foot lugs in order to connect the first fork foot to the second fork foot.

A device of this kind is known from DE 39 17 034 A1. In this case, a propeller blade is fastened to a hinge. For this purpose, a hinge pin is inserted into holes in the fork foot which is fixedly connected to the rotor and into holes of the fork foot which is fixedly connected to the propeller. Low-friction bearing bushes are arranged in the holes of the fork foot which is connected to the propeller, the hinge pin being received in these bearing bushes.

DE 29 52 023 A1 shows a blade holding device for locking a blade in a turbomachine rotor. The blade is held at the rotor by a dovetail connection at its radial inner end. A spring spacer which exerts a force on the dovetail that is directed radially outward is arranged in the groove which receives the dovetail.

SUMMARY OF THE INVENTION

It is an object of the present invention to improve a connection of a blade of a continuous flow machine to a rotor shaft.

This object is met by a device for connecting a blade to a rotor shaft of a continuous flow machine, in particular of a steam turbine or gas turbine or compressor, comprising a first fork foot which is fixedly connected to the blade, in particular formed integral therewith, wherein the first fork foot has a quantity of first foot lugs with first bore holes, a second fork foot which is fixedly connected to the rotor shaft, in particular formed integral therewith, wherein the second fork foot has a quantity of second foot lugs with second bore holes, and at least one connection bolt which passes through first and second bore holes to connect the first fork foot to the second fork foot.

According to the present invention, the device has a first area with a predetermined first diameter difference between a first inner diameter of a bore hole in at least one foot lug and a first outer diameter of the connection bolt, and a second area with a predetermined second diameter difference between a second inner diameter of a bore hole in at least one foot lug and a second outer diameter of the connection bolt, wherein the first diameter difference and the second diameter difference differ from one another, particularly quantitatively.

Accordingly, the present invention provide different fits in different axial areas of the shaft-hub connection in order to deliberately adjust the axial distribution of the compressive stresses in the contact areas and, therefore, the axial distribution of the centrifugal forces.

By the term "quantity" as used herein, is meant that there is at least one foot lug, but there may also be two or more foot lugs. However, it is indispensable for a stable connection that at least one of the two fork ends has at least two foot lugs which enclose at least one foot lug of the other fork foot.

By area is meant within the meaning of the present invention generally an area coaxial to the connection bolt and to the hole axis in which the connection bolt makes contact in the bore hole so that a transmission of force is possible between the connection bolt and the inner surface of the bore hole. An area of this kind can have an axial extension along the hole axis or connection bolt axis which corresponds to the axial extension of one or more foot lugs.

However, the axial extension of an area can also be smaller than the axial extension of a foot lug and, in particular, can also be virtually linear.

The diameter differences $\Delta D_i$ are given by subtracting the outer diameter $D_i$ of the connection bolt from the inner diameter $d_i$ of the bore hole at the respective areas:

$$\Delta D_1 = d_1 - D_1.$$

Since elastic and/or plastic changes may take place at the connection bolt and at the bore hole during the process of mating the connection bolt in the bore hole, the dimensions after the manufacture of the connection bolt and bore holes and before the mating of the connection bolt in the bore holes are critical.

Due to the different diameter differences in the different areas, the flux of force transmitted into the areas can be deliberately predetermined according to the present invention and the loading of the individual components of the device can in this way be deliberately controlled and therefore also reduced. Accordingly, the diameter difference at an area which would be exposed to high loading with a fit remaining substantially the same over the axial extension of the entire shaft-hub connection can be selected so as to be greater than in another area, which leads to reduced loading in this area. In so doing, the bolt is allowed a greater freedom of movement in the bore hole than in another area. Further, there can be a deliberate weakening of the connection bolt and/or foot lug in the corresponding area so that the connection bolt and/or foot lug can yield to the acting loads. This causes the loads to be redistributed to other areas so that the area with the increase in the diameter difference is consequently relieved. When the areas of different diameter differences are located at different connection bolts, the loads can be deliberately shifted from one of the connection bolts to the other.

In a preferred embodiment, the inner diameters of at least one of the bore holes can be substantially identical and the outer diameters of the at least one connection bolt can be different in the first area and second area. This corresponds to the hole basis system of fits and has the advantage that all of the bore holes can be manufactured with only one individual tool in one work step.

Alternatively, in another preferred embodiment, the outer diameters of the at least one connection bolt can be substantially identical and the inner diameters of the bore holes can differ in the first area and second area. This corresponds to the shaft basis system of fits. In this connection, it is advantageous that the connection bolts can be produced in a simplified manner and that when a plurality of connection bolts are used for fastening a blade all of the connection bolts are identical, which reduces the number of parts.

Both aspects can also be combined in that the outer diameters of the at least one connection bolt and the inner diameters of the bore holes differ from one another in the first area and second area.

The first diameter difference and the second diameter difference preferably form different fits. In this case, while the connection bolts and the bore holes have the same nominal dimensions, the diameter differences are produced in that different tolerance positions are set for the bore hole and connection bolt as is mentioned, for example, in Dubbel, Taschenbuch für den Maschinenbau, 22nd printing, pages F32, F33 which is incorporated herein by reference.

One of the diameter differences preferably forms a wider fit, preferably at least a medium interference fit, particularly a transition fit or a clearance fit. In addition or alternatively, at least one of the diameter differences can have a tighter fit, preferably at least a wringing transition fit, particularly a medium or tight interference fit. In this connection, a tighter fit means that the corresponding diameter difference is less than the diameter difference of the wider fit. Conversely, by "wider fit" is meant that the corresponding diameter difference is greater than the diameter difference of the tighter fit.

In another preferred embodiment, the connection device has at least a third area with a third diameter difference between a third inner diameter of one of the bore holes and a third outer diameter of the connection bolt, wherein the second area is arranged axially between the first area and the third area, and the second diameter difference is greater than the first diameter difference and/or the third diameter difference.

Accordingly, the second area is arranged between the first area and the third area. Because the second diameter difference is greater than the first diameter difference and third diameter difference, the connection bolt is waisted somewhat in the second area. The connection bolt and/or the bore hole are/is accordingly relieved in the second area, i.e., in the axially medial area, wherein the flux of force is increasingly deflected to the outer areas, namely, the first area and the third area. This is preferably achieved in that a tighter fit, at least a wringing transition fit, particularly a medium or tight interference fit, is provided in the first area and/or third area and that a wider fit, at least a medium interference fit, particularly a transition fit or a clearance fit, is provided in the second area.

Accordingly, in an advantageous construction, an interference fit, for example, particularly R7/h6, can be provided between the bore hole and the connection bolt at the first area, and a clearance fit, particularly H7/h6, can be provided between the bore hole and the connection bolt at the second area. An interference fit, particularly R7/h6, can preferably be provided between the bore hole and the connection bolt at a third area.

In a preferred embodiment, first bore holes are arranged coaxial to a first common hole axis and/or second bore holes are arranged coaxial to a common second hole axis. As a result, the bore holes lie on a common axis so that the bore holes can be penetrated by an individual connection bolt. In an alternative embodiment, first bore holes are arranged parallel to one another and second bore holes are arranged parallel to one another. The bore holes lie on axes which are offset relative to one another so that a plurality of connection bolts are used to connect. The areas with different diameter differences can also be spread among different connection bolts.

The transitions between two areas are preferably continuous. In particular, this applies to the transitions of the areas at the connection bolt when the connection bolt has different outer diameters. Notch stresses on the connection bolt are prevented in this way. Continuous, i.e., not sudden, transitions of this kind can be realized, for example, by means of transition radii, continuous transitions, and the like.

A connection bolt preferably penetrates bore holes in at least three foot lugs, wherein one of the second or first foot lugs is arranged between at least two other of the first or second foot lugs.

It will be apparent that "area" within the meaning of the present invention refers only to those locations of the connection arrangement at which the connection bolt makes contact in one of the bore holes in a force-transmitting manner.

The connection bolt can be substantially cylindrical or substantially conical, for example. The deviations in diameter necessary for forming the diameter differences can be ignored when assessing whether a connection bolt is cylindrical or conical.

Further, an object upon which the present invention is based is met by a method for producing a connection arrangement of the kind mentioned above which is characterized in that areas with different inner diameters are formed according to plan in the bore holes and/or areas with different outer diameters are formed according to plan at a connection bolt. By forming according to plan is meant in particular that corresponding manufacturing tolerances are adhered to during production, particularly during finishing, of bolts and bore holes which ensure the specified diameter differences.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

Further features and advantages of the present invention are described with reference to the drawings in which.

Figure 4:
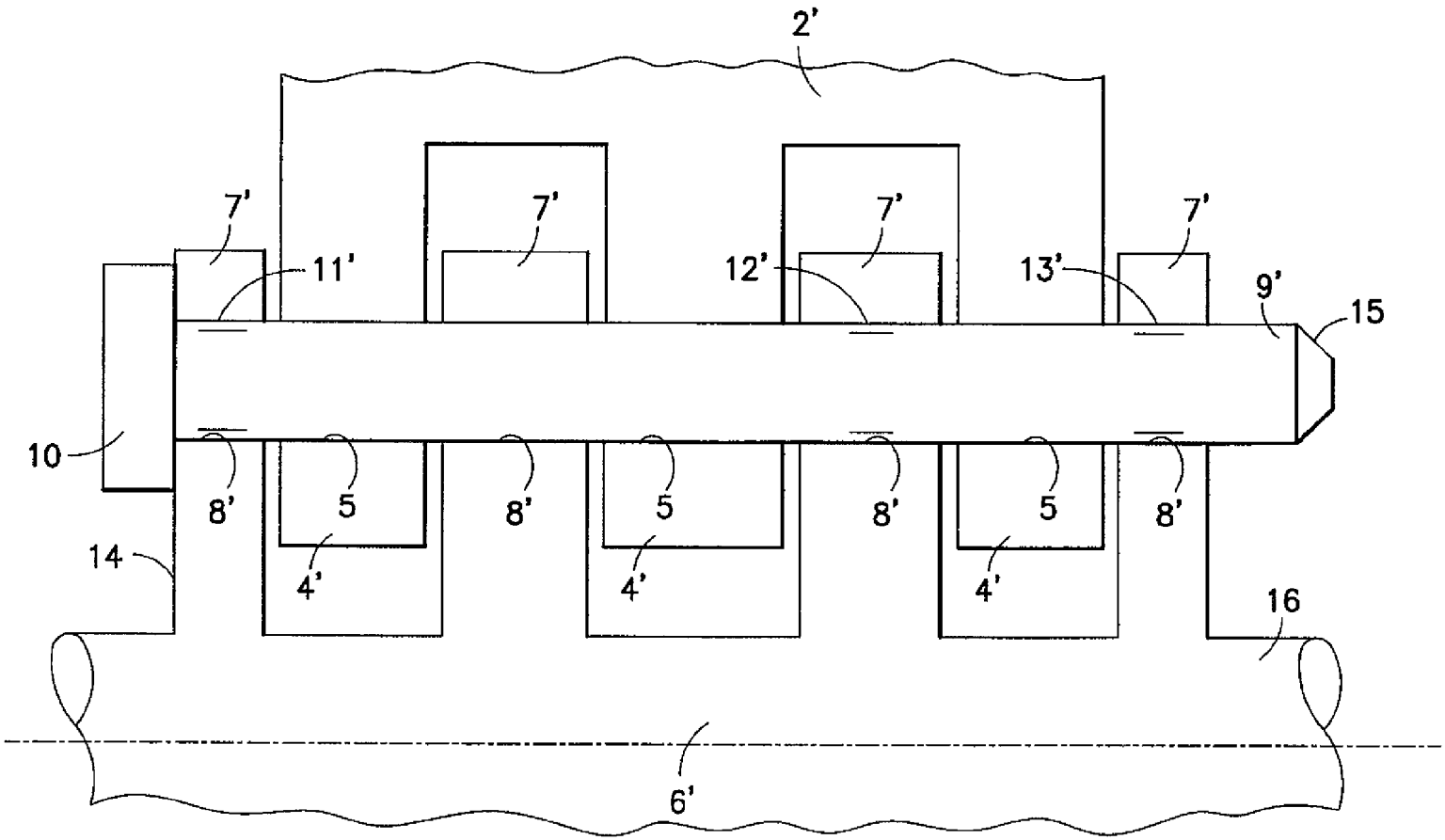
Figure 5:
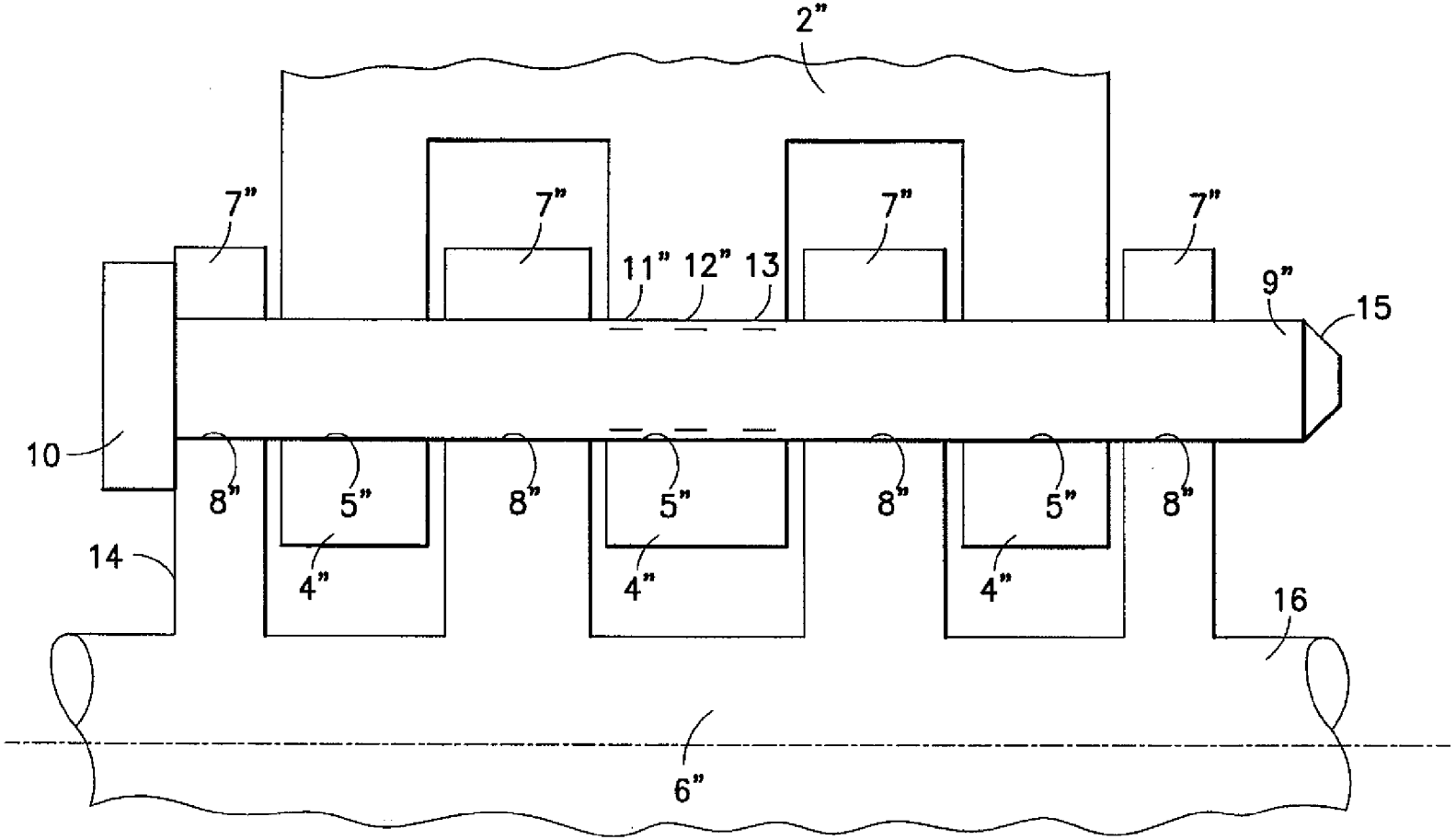
Figure 6:
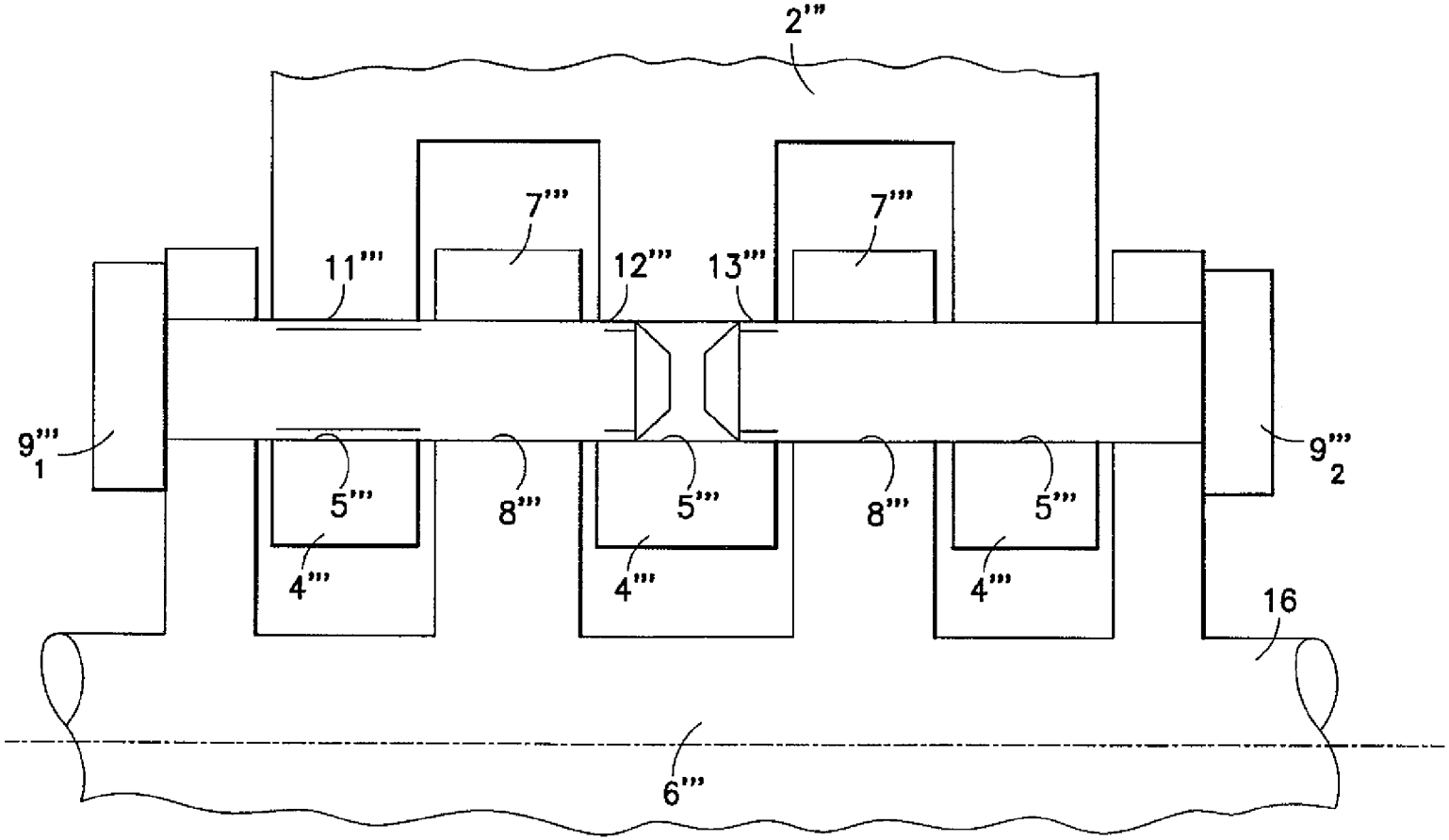
Figure 7:
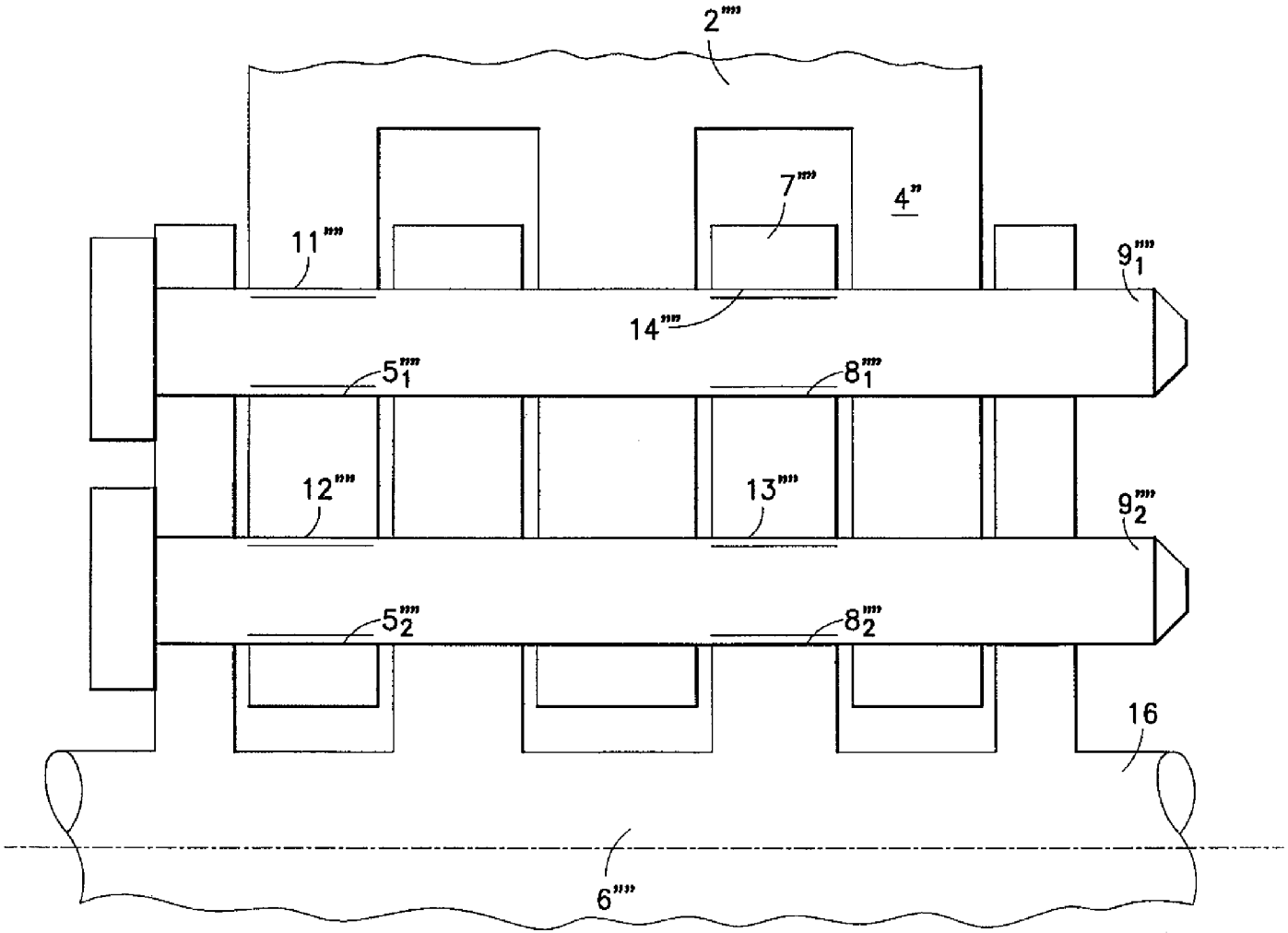

FIG. 4 a device according to the invention in a second embodiment;

FIG. 5 shows a device according to the invention in a third embodiment;

FIG. 6 shows a device according to the invention in a fourth embodiment;

FIG. 7 shows a device according to the invention in a fifth embodiment; and

Figure 8:
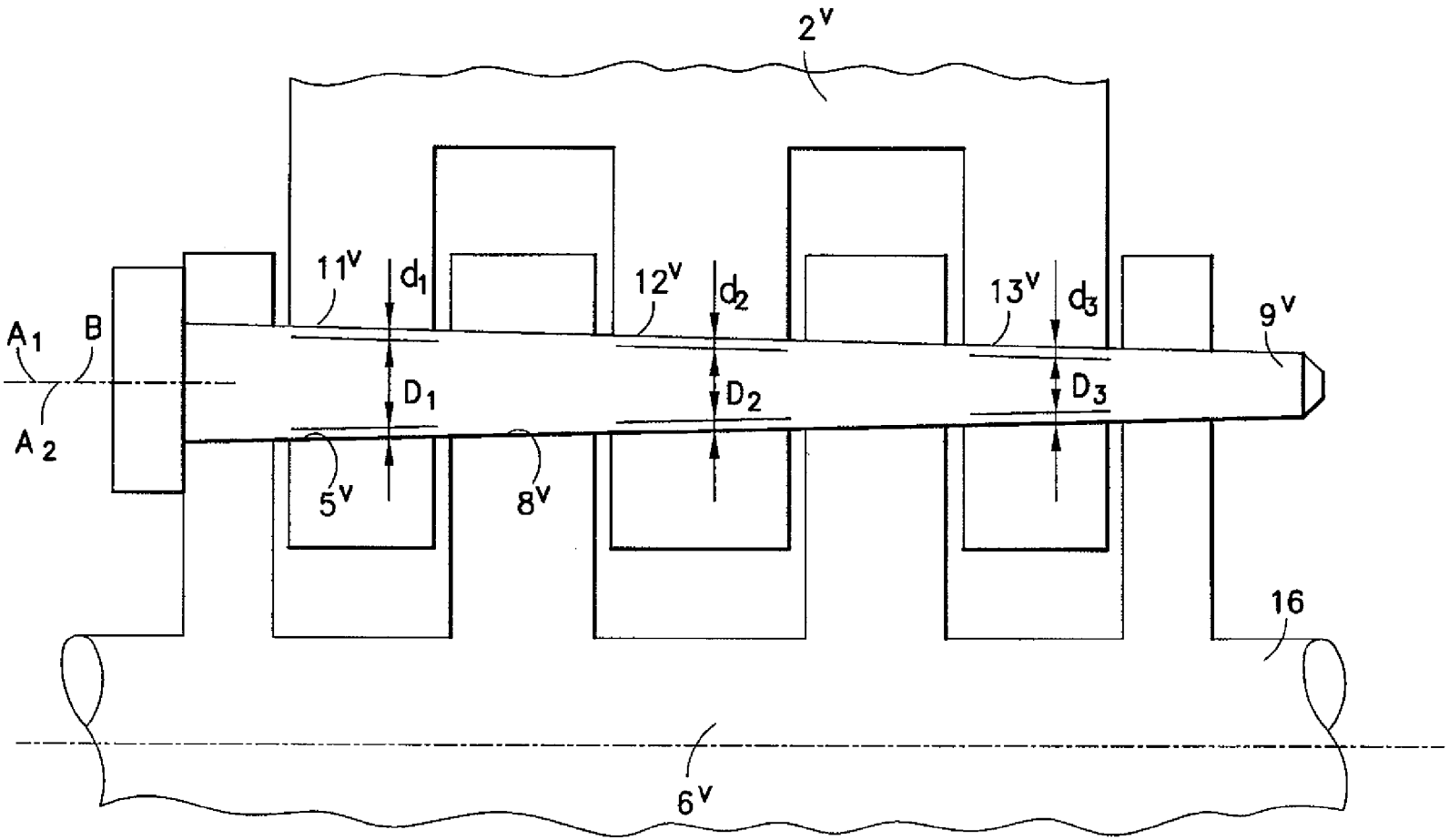

FIG. 8 shows a device according to the present invention in a sixth embodiment.

DETAILED DESCRIPTION OF THE PRESENTLY PREFERRED EMBODIMENTS

Figure 1:
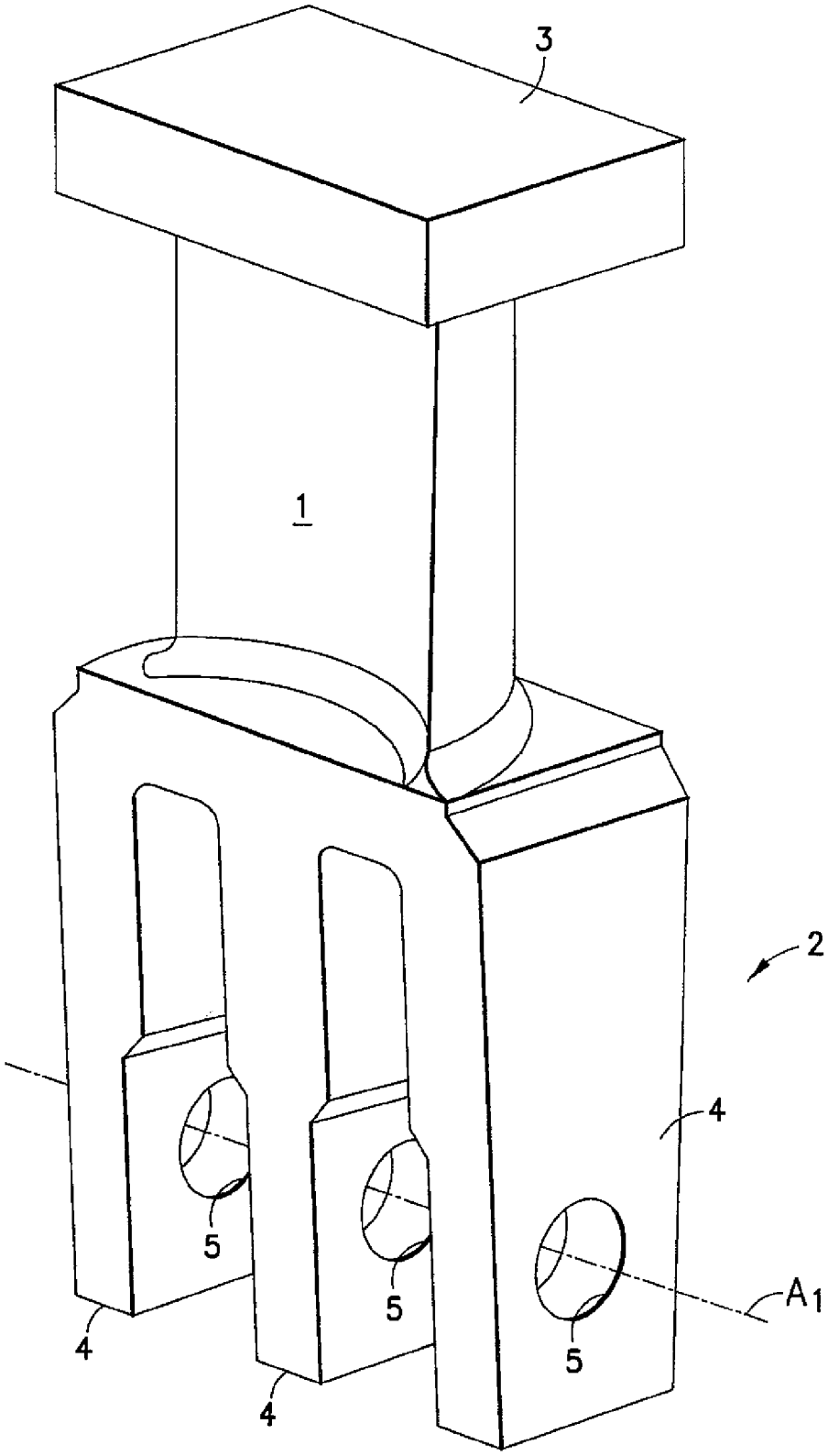
FIG. 1 shows a blade of a compressor.

FIG. 1 shows a rotor blade 1 of a steam turbine, a first fork foot 2 being formed integral with the rotor blade 1. At the end of the rotor blade 1 remote of the first fork foot, a cover plate 3 is connected to the rotor blade 1. The rotor blade 1, the first fork foot 2 and the cover plate 3 are cut from a semi-finished product. The first fork foot 2 has a total of three first foot lugs 4, each of which has a first bore hole 5. These first bore holes 5 are arranged coaxial to one another on a common first hole axis $A_1$.

Figure 2:
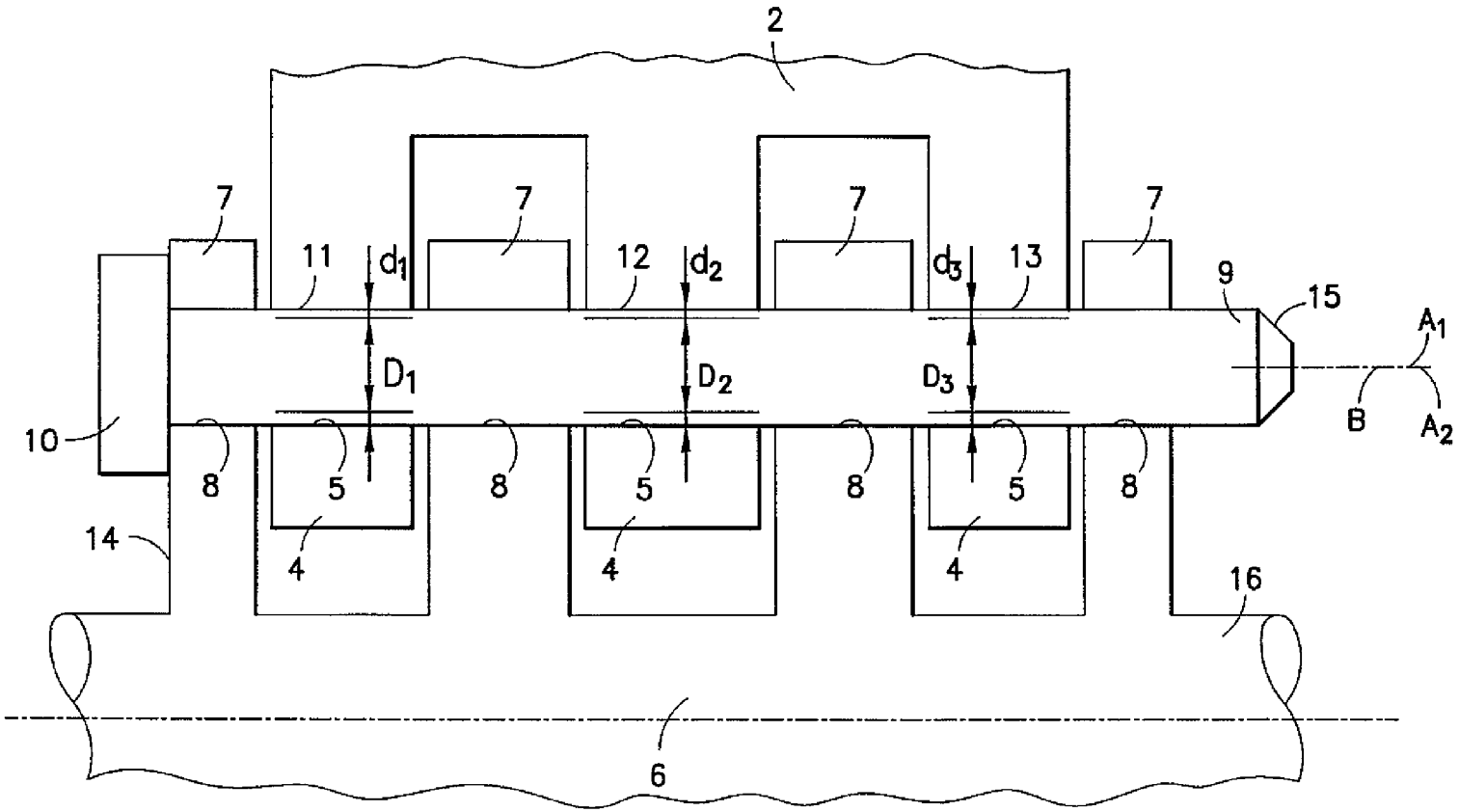
FIG. 2 shows a device constructed according to the invention in longitudinal section.

FIG. 2 shows a device for connecting the turbine blade to a rotor shaft 16. Shown next to the first fork foot 2 is a second fork foot 6 which has a total of four second foot lugs 7. The second foot lugs 7 each have a second bore hole 8 which is arranged coaxial to a second hole axis $A_2$. The second fork foot 6 is formed integral with the rotor shaft 16, for example, by milling out the rotor shaft.

In the connected state shown in FIG. 2, the first hole axis $A_1$ is arranged coaxial to the second hole axis $A_2$, the three first foot lugs 4 projecting into intermediate spaces which are formed by the four second foot lugs 7.

A connection bolt 9 is inserted through the first bore holes 5 and the second bore holes 8. The connection bolt 9 has a bolt head 10 which contacts an end face 14 of one of the second foot lugs 7 so that the position of the connection bolt 9 is fixed axially relative to the second fork foot 6. The connection bolt 9 is secured axially relative to one of the fork foots 2, 6 by an interference fit, which will be described in the following, and/or by securing means, not shown. In a modification which is not shown, the connection bolt has no bolt head but rather terminates on one or both end faces with the respective end face of the second foot lug. For this purpose, it preferably has an excess length when assembled and is cut off at the end after pinning. Similarly, the connection bolt can also project out on one or both front sides relative to the respective end face of the second foot lug or can be set back relative to the latter.

In the connected state as shown in FIG. 2, three axial areas 11, 12, 13 can be distinguished in which the connection bolt 9 makes contact in the first bore holes 5 in a force-transmitting manner. In a first area 11 (at left in FIG. 2), the connection bolt 9 has a first outer diameter $D_1$ and the first bore hole 5 has a first inner diameter $d_1$. In a second area 12 (in the center in FIG. 2), the connection bolt 9 has a reduced outer diameter $D_2$ and the bore hole 5 has a second inner diameter $d_2$. In a third axial area 13 (at right in FIG. 2), the connection bolt 9 has a third outer diameter $D_3$ and the bore hole 5 has a third inner diameter $d_3$. The second lines at the connection bolt in areas 11, 12, 13 indicate the axial extension of the respective areas. Accordingly, all of the areas 11, 12, 13 have an axial extension along the connection bolt axis B which corresponds to the axial extension of the corresponding first foot lugs 4. The diameter difference $\Delta D_1$ (i="first area 11", second area 12", "third area 13") for all areas is given by subtracting the respective outer diameter $D_1$ of the connection bolt from the respective inner diameter $d_1$ of the bore hole in the respective area:

$$\Delta D_1 = d_1 - D_1$$

In the present example, the first diameter difference and the third diameter difference are formed in that the inner diameters of the bore holes and the outer diameters of the connection bolt have identical nominal dimensions, but the tolerance position pair of the diameters in the first area 11 and third area 13 form an interference fit. The tolerance position pair R7/h6 is a suitable example of a value for a fit. The second diameter difference is formed by a clearance fit. A suitable tolerance position pair is a fit of H7/h6. By providing a larger diameter difference at the second area 12 than at the first area 11 and third area 13, the connection bolt 9 in the bore hole 5 is given greater freedom of movement at the second area 12 than in another area 11, 13. Further, the connection bolt is deliberately weakened at the second area 12 so that the connection bolt can yield to the correspondingly acting loads. This results in a redistribution of the loads to the other areas 11, 13 so that the second area 12 is consequently relieved because of the increased diameter difference.

Figure 3A:
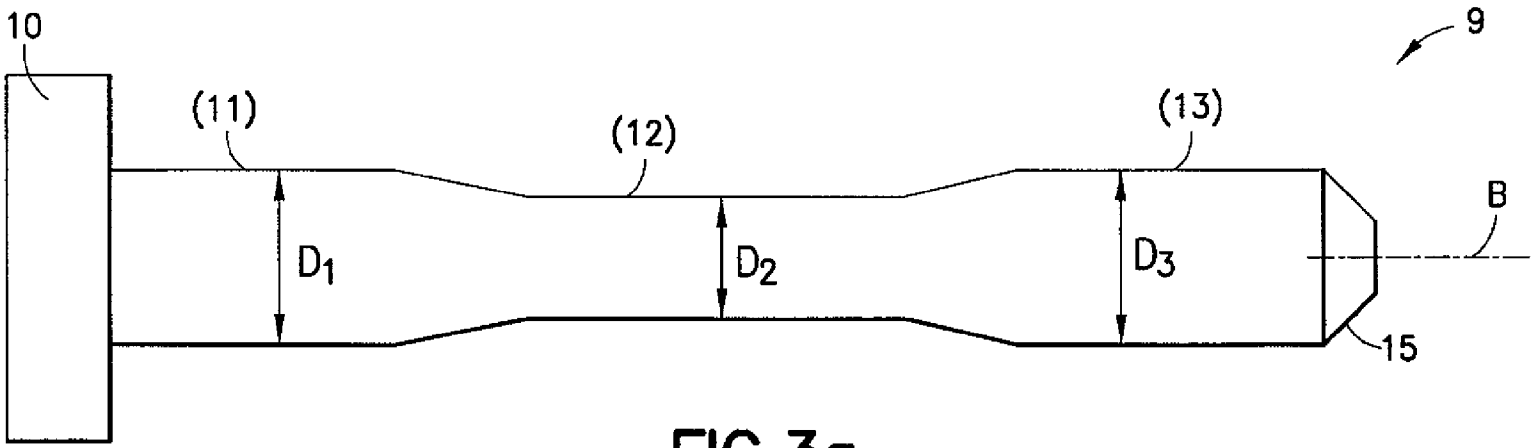
FIG. 3 shows the connection bolt from FIG. 2 a) in an exaggerated view, and b) represented to scale.
Figure 3B:
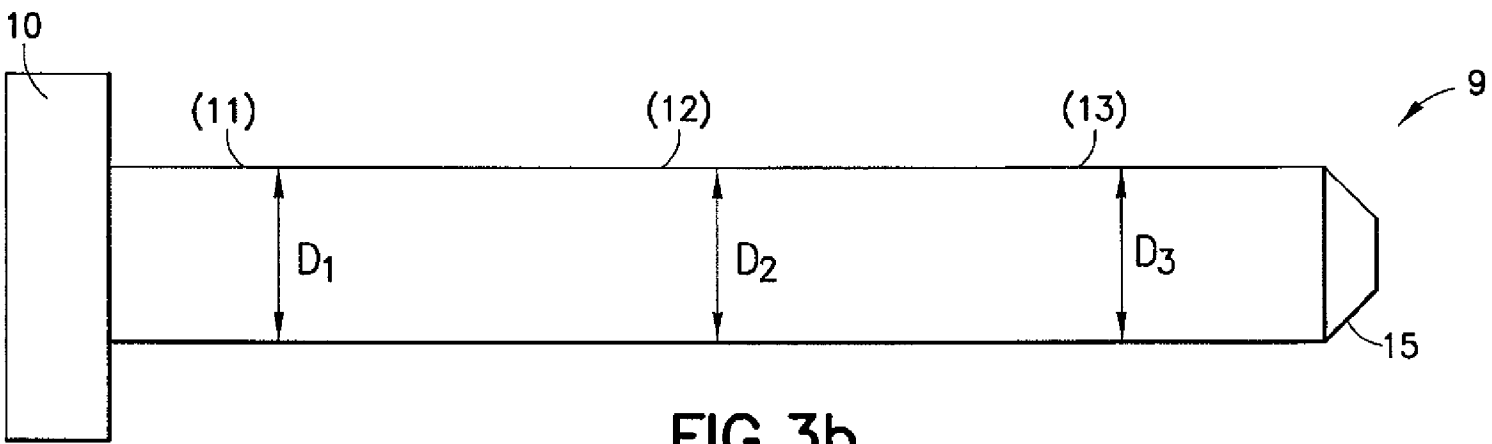

The connection bolt 9 which is shown in the device according to FIGS. 1 and 2 is shown in detail in FIGS. 3*a* and 3*b*. As can be seen, the locations 11, 12, 13 at the connection bolt 9 identified by reference numerals in parentheses together with the corresponding locations at the foot lugs form the areas 11, 12, 13 of the connection device. The areas are only produced by the force-transmitting connection with the foot lugs; therefore, the reference numerals appear in parentheses. The transitions of the different outer diameters $D_1$, $D_2$, $D_3$ at the connection bolt 9 are continuous so that the transitions between the areas 11, 12, 13 in the connected state of the device for connecting are likewise continuous.

In FIG. 3*a*), which shows the bolt with exaggerated diameter ratios, it can be seen that diameter $D_2$ is smaller than the identical diameters $D_1$ and $D_3$ of the bolts, i.e., it has a waist in the middle. However, the connection bolt 9 is shown in an exaggerated manner in FIG. 3*a*) to make visible the difference between the second diameter $D_2$ and the two other diameters $D_1$, $D_3$. However, in fact, the connection bolt 9 has the same appearance as shown in FIG. 3*b*). The differences between the second outer diameter $D_2$ and the two other outer diameters $D_1$, $D_3$ are of an order of magnitude such that they cannot be perceived by the naked eye. The connection bolt 9 has a bevel 15 at its axial end remote of the bolt head 10. This bevel 15 does not rest in a bore hole in a force-transmitting manner.

FIG. 4 shows a second embodiment of a device for connecting which largely corresponds to the embodiment according to FIGS. 1 to 3. The areas 11', 12', 13' are arranged in the area of the second foot lugs 7' between the second bore holes 8' and the connection bolt 9'. The axial extension of the three areas is indicated by the second lines at the connection bolt. All of the areas 11', 12', 13' have an axial extension which is smaller than the axial extension of the respective foot lug 7'.

FIG. 5 shows a third embodiment of a device for connecting, according to the present invention, which substantially corresponds to the embodiment according to FIGS. 1 to 3. Three areas 11", 12", 13" are arranged in the area of the middle foot lug 7' of three first foot lugs 4". The axial extension of the three areas is indicated by the second lines at the connection bolt and always corresponds to only a fraction of the axial extension of the corresponding foot lug 4". The connection bolt 9 has a constant outer diameter along its entire axial length. On the other hand, the bore hole 5" of the middle of the three first foot lugs 4" has a different inner diameter. In the second area 12", the inner diameter is reduced compared to the inner diameters in the first area 11" and third area 13".

FIG. 6 shows a fourth embodiment of a device for connecting, according to the present invention, which substantially corresponds to the embodiment according to FIGS. 1 to 3. A total of two connection bolts $9_1'''$ and $9_2'''$ are inserted into the first bore holes 5''' of the first fork foot 2''' and the second bore holes 8''' of the second fork foot 6''' from two different sides. The two bolts $9_1'''$ and $9_2'''$ together have a length that is shorter than the axial extension of the second fork foot 6'''. The first area 11''' and the second area 12''' are arranged between the first connection bolt $9_1'''$ and two foot lugs 4''' of the first fork foot 2'''. The third area 13''' is arranged between the second connection bolt $9_2'''$ and the first foot lug 4'''.

FIG. 7 shows a fifth embodiment of a device for connecting, according to the present invention, which corresponds substantially to the embodiment according to FIGS. 1 to 3. It can be seen that the foot lugs 4'''', 7'''' of the first fork foot 2'''' and of the second fork foot 6'''' each have two bore holes $5_1''''$, $5_2''''$, $8_1''''$, $8_2''''$. The two different bore holes $5_1''''$, $5_2''''$; $8_1''''$, $8_2''''$ of a fork foot are arranged so as to be offset parallel to one another. Further, two connection bolts $9_1''''$, $9_2''''$ are provided which are guided through the respective bore holes $5_1''''$, $5_2''''$, $8_1''''$, $8_2''''$. The first area 11'''' is formed between a first bore hole $5_1''''$ and a connection bolt $9_1''''$. The second area 12'''' is formed between the other first bore hole $5_2''''$ and the other connection bolt $9_2$''''. The third area 13'''' is formed between a second bore hole $8_2$'''' and the other connection bolt $9_2$'''' and the fourth area 14'''' is formed between another second bore $8_1$'''', and the connection bolt $9_1$''''.

FIG. 8 shows a sixth embodiment of a device for connecting, according to the present invention, which substantially corresponds to the embodiment according to FIGS. 1 to 3. The connection bolt $9^V$ and bore holes $5^V$, $8^V$ have a substantially conical shape. Areas $11^V$, $12^V$, $13^V$ are shown which differ from one another with respect to the diameter differences $\Delta D_1$, $\Delta D_2$, $\Delta D_3$ as in the preceding embodiments. The inner diameters of the bore holes and the outer diameters of the connection bolt at the respective areas are not constant due to their conical shape, but change along the bore axis and connection bolt axis $A_1$, $A_2$, B. However, the diameter differences $\Delta D_1$, $\Delta D_2$, $\Delta D_3$ between the outer diameters and the inner diameters are always substantially constant within an area 11, 12, 13.

As in the first embodiment, the connection bolts of the second, third, fourth, fifth or sixth embodiment can also be formed without bolt heads in a modification which is not shown and in particular can terminate on one or both front sides with the respective end face of a foot lug.

The invention is not limited by the embodiments described above which are presented as examples only but can be modified in various ways within the scope of protection defined by the appended patent claims.

We claim:

1. A connection device for connecting a blade (1) to a rotor shaft (16) of a continuous flow machine, comprising:

a first fork foot (2) fixedly connected to a blade (1), said first fork foot (2) having a plurality of first foot lugs (4) each with a first bore hole (5);

a second fork foot (6) fixedly connected to said rotor shaft, said second fork foot (6) having a plurality of second foot lugs (7) each with a second bore hole (8);

at least one connection bolt (9) which passes through said first bore holes (5) and said second bore holes (8) in an axial direction for connecting said first fork foot (2) to said second fork foot (6);

a first cylindrical area (11) having a predetermined first diameter difference ($\Delta D_1$) between a first inner diameter ($d_1$) of one of said first bore holes (5) and said second bore holes (8) and a first outer diameter ($D_1$) of said connection bolt (9); and a second cylindrical area (12) having a predetermined second diameter difference ($\Delta D_2$) between a second inner diameter ($d_2$) of one of said first bore holes (5) and said second bore holes (8) and a second outer diameter ($D_2$) of said connection bolt (9); wherein said first diameter difference ($\Delta D_1$) and said second diameter difference ($\Delta D_2$) differ from one another; and wherein said first outer diameter ($D_1$) and said second outer diameter ($D_2$) differ from one another.

2. The connection device according to claim 1, wherein the first inner diameter and the second inner diameter of at least one of said first bore holes and said second bore holes ($d_1$, $d_2$) are substantially identical and said first outer diameter and said second outer diameter ($D_1$, $D_2$) of said at least one connection bolt (9) differ in said first axially extending area (11) and said second axially extending area (12).

3. The connection device according to claim 1, wherein the first outer diameter and the second outer diameter ($D_1$, $D_2$) of said at least one connection bolt (9) are substantially identical and said first inner diameter and said second inner diameter ($d_1$, $d_2$) of said first and second bore holes (5, 8) differ in said first axially extending area (11) and said second axially extending area (12).

4. The connection device according to claim 1, wherein said first diameter difference ($\Delta D_1$) and said second diameter difference ($\Delta D_2$) form different fits.

5. The connection device according to claim 1, wherein at least one of said first diameter differences ($\Delta D_1$) forms a first fit which is different from a second fit of said second diameter difference.

6. The connection device according to claim 5, wherein at least one of said first fit and said second fit is a medium interference fit.

7. The connection device according to claim 6, wherein at least one of said first fit and said second fit is of one of a transition fit and a clearance fit.

8. The connection device according to claim 1, wherein at least one of said first diameter difference and said second diameter difference forms a relatively tighter fit.

9. The connection device according to claim 8, wherein at least one said fit is at least a wringing transition fit.

10. The connection device according to claim 9, wherein at least one said fit is one of a medium and tight interference fit.

11. The connection device according to claim 1, additionally comprising at least a third axially extending area (13) with a third diameter difference ($\Delta D_3$) between a third inner diameter ($d_3$) of one of said first bore holes and said second bore holes (5, 8) and a third outer diameter ($D_3$) of said at least one connection bolt (9); and wherein said second axially extending area (12) is arranged axially between said first axially extending area (11) and said third axially extending area (13), and said second diameter difference ($\Delta D_2$) is greater than one of said first diameter difference ($\Delta D_1$) and said third diameter difference ($\Delta D_3$).

12. The connection device according to claim 11, wherein a relatively tighter fit is provided in one of said first axially extending area and said third axially extending area (13); and a relatively wider fit is provided in said second axially extending area.

13. The connection device according to claim 12, wherein said relatively tighter fit is at least a wringing transition fit; and said relatively wider fit is at least a medium interference fit.

14. The connection device according to claim 11, additionally comprising a transition between said first axially extending area and said second axially extending area; said transition between two axially extending areas (11, 12, 13) being continuous.

15. The connection device according to claim 11, wherein said at least one connection bolt (9) makes contact in said first bore holes and said second bore holes (5, 8) in a force-transmitting manner at said first and said second axially extending areas (11, 12, 13).

16. The connection device according to claim 1, wherein said at least one connection bolt (9) penetrates said first bore holes and said second bore holes (5, 8) in at least three of said first foot lugs and at least three of said second foot lugs (4, 7); and wherein said first foot lug (7, 4) is arranged between two of said second foot lugs (4, 7).

17. The connection device according to claim 1, wherein said at least one connection bolt (9) is substantially cylindrical.

18. The connection device according to claim 1, wherein said at least one connection bolt (9) is substantially conical.

19. The connection device according to claim 1, wherein said at least one connection bolt (9) penetrates said first bore holes and said second bore holes (5, 8) in at least three of said first foot lugs and at least three of said second foot lugs (4, 7); and wherein said one of said second foot lugs is arranged between two of said first foot lugs.

20. A method for producing a connection arrangement comprising a connection device for connecting a blade (1) to a rotor shaft (16) of a continuous flow machine, said connection device comprising:

a first fork foot (2) fixedly connected to a blade (1), said first fork foot (2) having a plurality of first foot lugs (4) each with a first bore hole (5);

a second fork foot (6) fixedly connected to said rotor shaft, said second fork foot (6) having a plurality of second foot lugs (7), each with a second bore hole (8);

at least one connection bolt (9) which passes through said first bore holes (5) and said second bore holes (8) in an axial direction for connecting said first fork foot (2) to said second fork foot (6);

a first cylindrical area (11) having a predetermined first diameter difference ($\Delta D_1$) between a first inner diameter ($d_1$) of one of said first bore holes (5) and said second bore holes (8) and a first outer diameter ($D_1$) of said connection bolt (9); and a second cylindrical area (12) having a predetermined second diameter difference ($\Delta D_2$) between a second inner diameter ($d_2$) of one of said first bore holes (5) and said second bore holes (8) and a second outer diameter ($D_2$) of said connection bolt (9);

wherein said first diameter difference ($\Delta D_1$) and said second diameter difference ($\Delta D_2$) differ from one another; and wherein said first outer diameter ($D_1$) and said second outer diameter ($D_2$) differ from one another, wherein one of said first cylindrical area and said second cylindrical area with different said first inner diameter and said second inner diameter are formed according to plan in said first bore holes and said second bore holes and one of said first cylindrical area and said second cylindrical area with different said first outer diameter and said second outer diameter are formed according to plan at the connection bolt.

* * * * *